United States Patent [19]

Fleissner

[11] 4,145,819

[45] Mar. 27, 1979

[54] APPARATUS FOR THE DRYING OF LENGTHS OF TEXTILE MATERIAL

[75] Inventor: Hans Fleissner, Riehen, Switzerland

[73] Assignee: Vepa AG, Switzerland

[21] Appl. No.: 752,853

[22] Filed: Dec. 21, 1976

[30] Foreign Application Priority Data

Dec. 24, 1975 [DE] Fed. Rep. of Germany ..... 2558648

[51] Int. Cl.[2] ..... F26B 13/30

[52] U.S. Cl. ..... 34/68; 34/115; 34/158; 34/216; 68/20

[58] Field of Search ..... 34/4, 41, 155, 115, 34/216, 217, 158, 68; 68/5 D, 5 E, 20

[56] References Cited

U.S. PATENT DOCUMENTS

| | | | |
|---|---|---|---|
| 3,207,828 | 9/1965 | Petersen et al. | 34/41 |
| 3,321,197 | 5/1967 | Parslow | 34/41 |
| 3,503,134 | 3/1970 | Fleissner | 34/158 |

FOREIGN PATENT DOCUMENTS 1604770 4/1974 Fed. Rep. of Germany.

*Primary Examiner*—John J. Camby
*Assistant Examiner*—Larry I. Schwartz
*Attorney, Agent, or Firm*—Craig & Antonelli

[57] ABSTRACT

An apparatus for the drying of lengths of textile material impregnated with a disperse dye or synthetic resin dispersion, which includes a preparatory drying section wherein the length of textile material is conducted in a contact-free manner and is subjected to a first drying operation and a sieve drum means for effecting a final drying treatment. The preparatory drying section includes a transverse tentering frame having a traveling transverse tentering means and is arranged upstream of the sieve drum means. This transverse tentering means is guided through a drying unit for effecting the preparatory drying operation.

5 Claims, 1 Drawing Figure

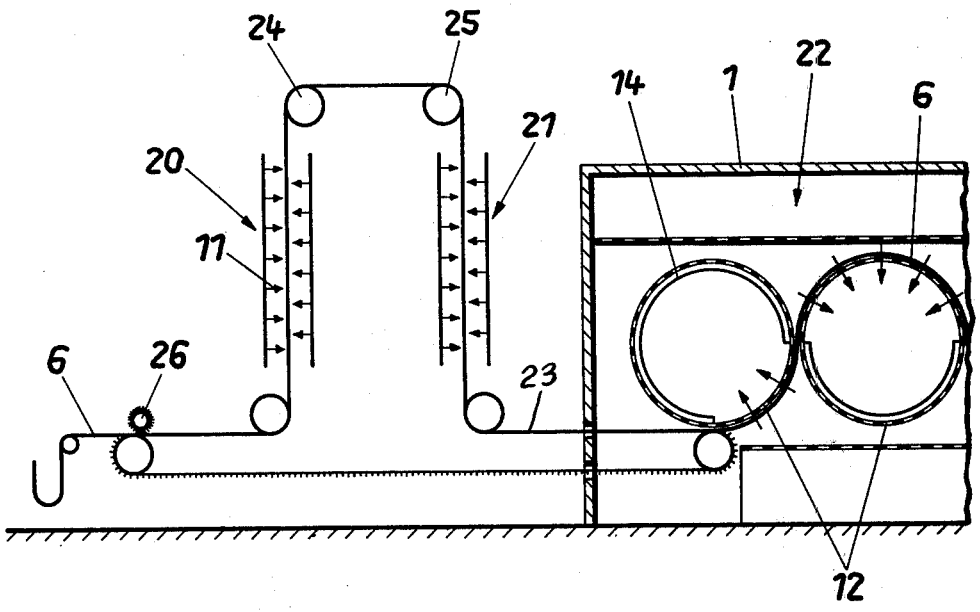
24
25
22
14
1
6
21
20
11
6
26
23
12

APPARATUS FOR THE DRYING OF LENGTHS OF TEXTILE MATERIAL

This invention relates to an apparatus for the drying of lengths of textile material previously impregnated with a treatment bath containing dyes, particularly disperse dyes, or a synthetic resin dispersion, e.g. a latex. This apparatus consists of a preparatory drying device wherein the length of textile material is conducted freely floating or suspended and is subjected to a first drying phase by a nozzle-ejected gaseous medium or by infrared radiation, and of a device with a sieve drum means operating with suction draft to effect the finishing treatment of the type disclosed in German Pat. No. 16 04 770.

Lengths of textile material provided with such dyes must be preliminarily dried without any contact, since the liquid agents applied to the lengths of material tend, in the wet condition, to adhere to the guide elements, and thus these guide elements are greatly contaminated already after relatively brief treatment times, which, in turn, would result in a non-uniform appearance of the material. To prevent this from happening, it is conventional to dry lengths of textile material without contact by means of infrared and floating dryers until the drying step is complete. However, in these dryers, the traveling velocity must be adapted extremely accurately to the drying capacity, for minor deviations lead to overdrying and, in certain cases, to a burning of the lengths of textile material.

To avoid this disadvantage, it is known to subject lengths of textile materials to a contact-free, preliminary drying step in a well or vertical tunnel, followed by a device for effecting the finishing drying step in order to complete the drying of the textile webs. This device can consist of a tentering frame. The tentering frame has the disadvantage that it is very expensive due to its adjustable tentering chains and due to its complicated structure over-all, and furthermore fills a relatively large amount of space. To avoid the necessity of having to provide an excessive number of tentering frame zones, the production rates are in most cases limited in connection with tentering frame systems. Higher production rates can be achieved by means of a hot-flue. In a hot-flue, the web-shaped textile material is guided on two series of rollers in a zig-zag path through the treatment chamber. The material is exposed to a stream of drying air on both sides so that here essentially a parallel ventilation of the material takes place. The parallel ventilation as well as the ventilation by means of nozzles provided in case of the tentering frame require relatively long drying times. However, this is extremely undesirable due to the textile properties of the material which are adversely affected by a long-term exposure to heat.

The invention according to the German patent is based on the problem of conducting a drying operation, even in case of textile webs which must be subjected to a contact-free preliminary drying step, so that the drying operation takes place in a maximally short time and extremely economically. However, this condition applies not only in case of textile webs which can be stressed longitudinally, as provided in the patent, but also in such textile webs which are sensitive to tensile stresses in the longitudinal and/or transverse directions.

This invention is based on the problem of developing an apparatus useable not only for textile webs which can be stressed longitudinally, but also for those which may not be as readily conducted freely over a rather long traveling path.

Starting with the apparatus according to the German patent, the solution of the above-posed problem is realized in that (1) a transverse tentering frame provided with traveling transverse tentering means is arranged upstream of the sieve drum means, (2) the point where the length of textile material is removed from the pins of the transverse tentering means is disposed before the transverse tentering means are deflected and in the immediate proximity of a jacket of the sieve drum taking over the length of textile material, and (3) the transverse tentering means are likewise guided through a first device for preparatory drying purposes. tentering means with the aid of the suction draft at the sieve drum. On account of the measures taken by the present invention, the transverse tentering means is now utilized not only for feeding the length of textile material to the sieve drum means, but also for the treatment of the length of material, by conducting the tentering means through the preparatory drying device, such as, for example, a drying well or a vertical tunnel dryer. The drying well is very disadvantageous for tension-sensitive lengths of textile material, since here the length of material is not guided in any way either in its width or in its length. Therefore, the advantageous apparatus according to the German patent has not been useable heretofore for tension-sensitive materials.

The transverse tentering means is, of course, endless. Thus, in a vertically arranged drying well, it is advantageous to dispose two drying wells in series and to conduct the transverse tentering means through the first well from the bottom to the top and then from the top to the bottom through the second well. For this purpose, it is merely necessary to deflect the transverse tentering means by respectively 90° over guide rollers. The length of textile material, i.e. each surface or face of the material, does not come into contact with any installations, so that a contact-free drying is made possible over the entire length of two drying wells.

The drawing shows one embodiment of the apparatus according to this invention.

The apparatus comprises a preparatory drying section and a textile finishing treatment section. Two vertically disposed drying wells 20, 21 serve for the preparatory drying operation, followed by a sieve drum means 22 to effect the finishing treatment. It will be understood that the liquid applicator means for impregnating the textile material with a treatment liquid, such as a bath containing a disperse dye or resin dispersion, is not shown but this applicator means is positioned upstream of the preparatory drying section. Also, means are usually provided for removing excess liquid from the textile material after the material leaves the bath. The sieve drums 12 are suitable, in particular, for uniformly heating the length of textile material 6 to a desired temperature. A hanging loop heat treatment system can directly follow the sieve drums after the heating step has been executed, for example, to the thermosoling temperature.

The transverse tentering means 23 arranged in front of the housing 1 of the sieve drum system 22 is disposed tangentially to the first sieve drum 12. The tentering means transfer the length of textile material 6 to the underside of the sieve drum 12, which drum is sealed against the suction draft in the zone not covered by the material by means of a cover or baffle 14. The suction draft within each sieve drum is generated by a fan located at the end face; this fan is not shown in detail.

Prior to being transferred to the sieve drum 12, the length of textile material 6 passes, together with the transverse tentering means 23, first through the drying well 20 from the bottom to the top and then through the drying well 21 from the top to the bottom. For a deflection by respectively 90°, sprocket wheels 24, 25 are provided, on which rest only the transverse tentering means; whereas the length of textile material 6 is freely guided also at those locations. To subject the textile web to a heat treatment in the two drying wells, infrared radiators or a nozzle blowing unit, indicated by 11, are provided. The textile web 6 is placed on the pins at point 26, i.e. approximately at the level where the length of textile material 6 is transferred to the first sieve drum 12.

In the preparatory drying section, the textile web 6 is preliminarily dried, for example, to a residual moisture content of about 30%. The complete drying of the textile material 6 then takes place on the two sieve drums 12 driven by motors not shown. Instead of the two sieve drums provided herein, one sieve drum will also be sufficient in many instances, or in case of a material which is more difficult to dry, any other desired number of sieve drums can likewise be utilized.

What is claimed is:

1. An apparatus for the drying of lengths of textile material impregnated with a treatment bath containing dyes, particularly disperse dyes, or a synthetic resin dispersion, said apparatus comprising a preparatory drying device having a transverse tentering frame with a traveling transverse tentering means for transporting the length of textile material in a contact-free manner with respect to the major surface thereof and a drying means for subjecting the length of textile material to a first drying operation and a sieve drum means for subjecting the length of textile material to a final drying treatment, said sieve drum means including a rotatable sieve drum with a suction draft positioned next to said preparatory drying device for removing the length of textile material from said tentering means, said tentering means being arranged to initially travel through said drying means for the preparatory drying operation of the length of textile material and then being deflected at a point near said sieve drum; the point where the length of textile material is removed from the transverse tentering means being disposed before the point where the transverse tentering means is deflected and in the immediate proximity of the sieve drum and being where said transverse tentering means is traveling in the same direction as the direction of rotation of the sieve drum.

2. An apparatus according to claim 1, wherein the drying means comprises a vertical drying well having means for heating the length of textile material, and the transverse tentering means extend vertically through said drying well.

3. An apparatus according to claim 2, wherein said drying means comprises two drying wells arranged in series, and the transverse tentering means is conducted through the first drying well from the bottom toward the top and through the second drying well from the top toward the bottom.

4. An apparatus according to claim 2, wherein said drying well has means for drying both sides of said textile material.

5. An apparatus according to claim 1, wherein the sieve drum means has a housing wherein said sieve drum is located, said sieve drum having a fan means for generating a suction draft therein, said point where the length of textile material is removed from the transverse tentering means being located inside said housing and subjacent to the sieve drum whereby the suction draft is applied to said length of textile material thereby facilitating removal of the length of textile material from said transverse tentering means.

* * * * *